United States Patent [19]

Kano et al.

[11] Patent Number: 4,785,978

[45] Date of Patent: Nov. 22, 1988

[54] CONTAINER CLOSURE PROVIDED WITH AUTOMATIC OPENING-CLOSING MECHANISM

[75] Inventors: Yuji Kano; Tsurusaburo Okamura, both of Chigasaki; Seiji Fukushi, Hiratsuka; Fumio Kinoshita, Niiza, all of Japan

[73] Assignee: Japan Crown Cork Co., Ltd., Tokyo, Japan

[21] Appl. No.: 159,159

[22] Filed: Feb. 23, 1988

[30] Foreign Application Priority Data

Mar. 2, 1987 [JP] Japan ..... 62-45354

[51] Int. Cl.[4] ..... B05B 11/04

[52] U.S. Cl. ..... 222/482; 215/309; 215/315; 222/213; 222/494; 222/496

[58] Field of Search ..... 215/309, 315; 222/213, 222/632, 494, 496, 482

[56] References Cited

U.S. PATENT DOCUMENTS 4,561,570 12/1985 Zulauf ..... 222/213 X

*Primary Examiner*—Donald F. Norton

*Attorney, Agent, or Firm*—Beveridge, DeGrandi & Weilacher

[57] ABSTRACT

A closure for containers comprises an automatic opening-closing mechanism and an outside closure member having a pour opening. The automatic opening-closing mechanism includes a plug member having a centrally formed air introduction hole and a plurality of liquid discharge ports formed around the air introduction hole, a first valve member for opening and closing the liquid discharge ports and a second valve member for opening and closing the air introduction hole.

11 Claims, 3 Drawing Sheets

CONTAINER CLOSURE PROVIDED WITH AUTOMATIC OPENING-CLOSING MECHANISM

FIELD OF THE INVENTION

This invention relates to a container closure provided with an automatic opening-closing mechanism, which is adapted to be applied to the mouth-neck portion of a container of the type in which a liquid held therein can be discharged by pressing its body portion out of shape.

DESCRIPTION OF THE PRIOR ART

It is known that a container which is formed of a suitable synthetic resin and at least a body portion of which can be elastically pressed out of shape is used for holding a liquid such as a shampoo or a washing liquor, and a closure provided with an automatic opening-closing mechanism and an outside closure member is attached to the mouth-neck portion of the container. A pour opening is formed in the outside closure member covering the automatic opening-closing mechanism in this container closure. The automatic opening-closing mechanism is so designed as to permit communication beween the inside and the outside of the container via the pour opening when the pressure in the container is increased and a negative pressure is created in it, and to maintain them non-communicable when the pressure in the container is substantially equal to atmospheric pressure. Hence, when the pressure in the container is increased by pressing its body portion out of shape, the inside and the outside of the container are brought into communication with each other, and the liquid in the container is discharged from the pour opening. When the pressing of the body portion is ceased, it elastically returns to its original shape, and a negative pressure is created in the container. Consequently, the inside and the outside of the container are brought into communication with each other. This, in turn, permits suction of air into the container through the pour opening, and thereafter, the inside and the outside of the container are kept out of communication.

Various types of the automatic opening-closing mechanism have been proposed and come into commercial acceptance, but still have problems to be solved. Among such problems are:

(a) the automatic opening-closing mechanism has a relatively complex structure because of using a metallic spring member such as a coil spring;

(b) it is impossible to stably control communication and non-communication between the inside and the outside of the container exactly as is required; and (c) the automatic opening-closing mechanism may fail to function after use for only a relatively short period of time.

SUMMARY OF THE INVENTION

It is an object of this invention to provide a container closure provided with an automatic opening-closing mechanism and an outside closure member, which is of a relatively simple structure and can be produced at low cost.

Another object of this invention is to provide a container closure provided with an automatic opening-closing mechanism and an outside closure member which functions properly with sufficient stability even when used repeatedly over an extended period of time.

According to this invention, there is provided a closure adapted to be applied to the mouth-neck portion of a container for holding a liquid at least a body portion of which can be elastically pressed out of shape, said closure comprising an automatic opening-closing mechanism to be mounted on the mouth-neck portion of the container and an outside closure member covering the automatic opening-closing mechanism and having a pour opening, said automatic opening-closing mechanism comprising a plug member having a centrally formed air introduction hole and a plurality of liquid discharge ports formed around the air introduction hole, a first valve member for opening and closing the liquid discharge ports and a second valve member for opening and closing the air introduction hole, said first valve member being formed of a flexible material and annular in shape and disposed over the plug member, and said first valve member being adapted to normally close the liquid discharge ports but when the pressure in the container is increased as a result of its body portion being pressed out of shape, to be elastically bent at its inside circumferential edge portion and to open the liquid discharge ports, and said second valve member having a base portion and a central valve portion connected to the base portion via an elastically bendable linking portion and disposed beneath the plug member, and said second valve member being adapted to normally close the air introduction hole by its central valve portion, but when the body portion of the container elastically returns to its original shape from its pressed state and a negative pressure is created in the container, to be elastically bent at its linking portion thereby displacing the central valve portion and thus to open the air introduction hole.

Preferably, the plug member has a central projecting portion through which the introduction hole extends. The outer circumferential surface of the upper end part of the central projecting portion has a tapered truncated conical shape, and the inner circumferential edge of the first valve member is usually kept in close contact with the outer circumferential surface of the upper end part of the central projecting portion. The first valve member may be made of a synthetic rubber and is of a flat annular plate shape. The base portion of the second valve member may be annular. The second valve member may have a plurality of linking portions spaced from each other at equiangular intervals, and each of the linking portions may be in the form of a slender filament having a deflecting part.

DETAILED DESCRIPTION OF PREFERRED EMBODIMENTS

Figure 1:
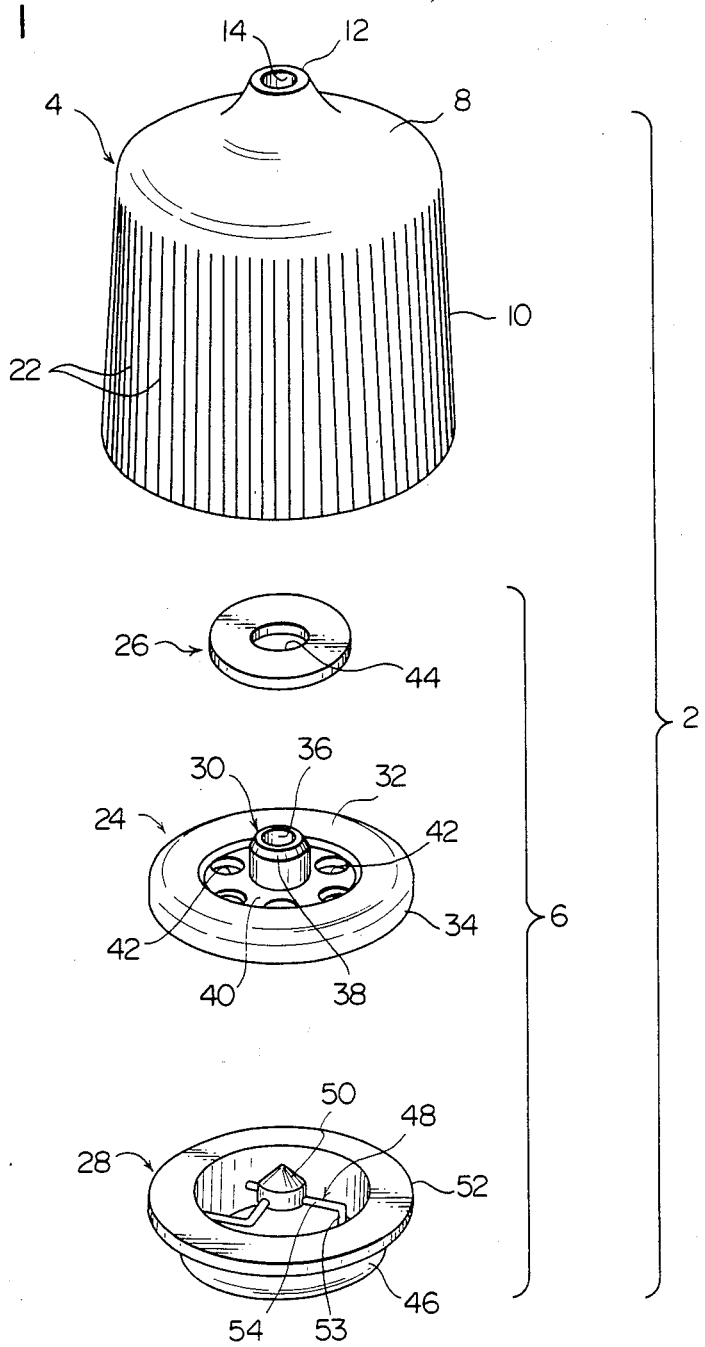
FIG. 1 is an exploded perspective view showing one embodiment of the closure constructed in accordance with this invention.
Figure 2:
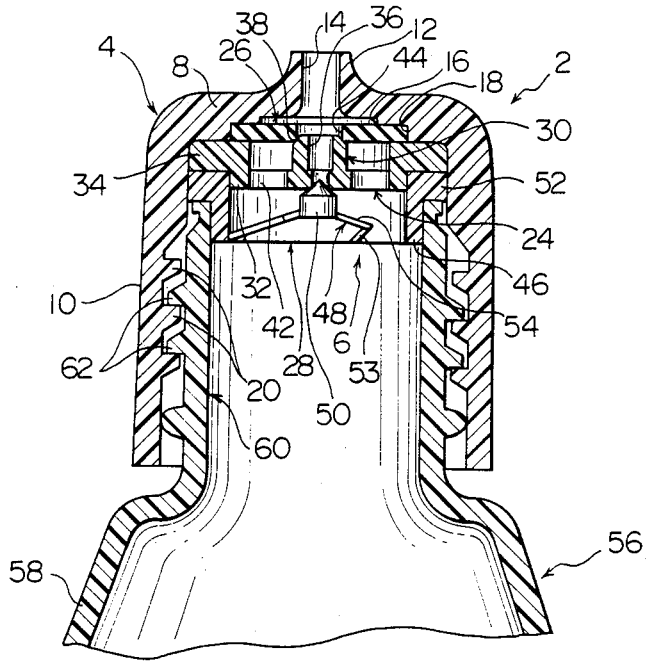
FIG. 2 is a sectional view showing the closure of FIG. 1 as it is applied to the mouth-neck portion of a container.

With reference to FIGS. 1 and 2, the illustrated closure constructed in accordance with this invention is shown generally at 2, and comprises an outside closure member 4 and an automatic opening-closing mechanism 6. The outside closure member 4 may be formed of a synthetic resin such as polypropylene or polyethylene, and has a circular top wall 8 and a nearly cylindrical skirt wall 10 extending downwardly from the peripheral edge of the top wall 8. A protruding portion 12 extending upwardly is provided centrally in the top wall 8, and a pour opening 14 is formed extending through the protruding portion 12. In the inside surface of the top wall 8 are formed a first annular step 16 surrounding the pour opening 14 and a second annular step 18 positioned outwardly of the first annular step 16. An internal thread 20 is formed in the inner circumferential surface of the skirt wall 10, and slip-preventing knurls 22 are formed on its outer circumferential surface.

Figure 3:
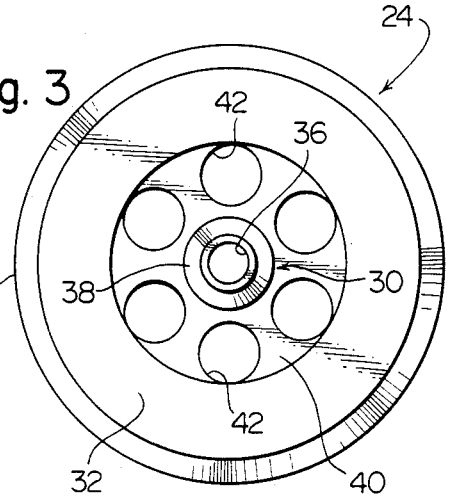
FIG. 3 is a top plan view of a plug member in the closure of FIG. 1.
Figure 4:
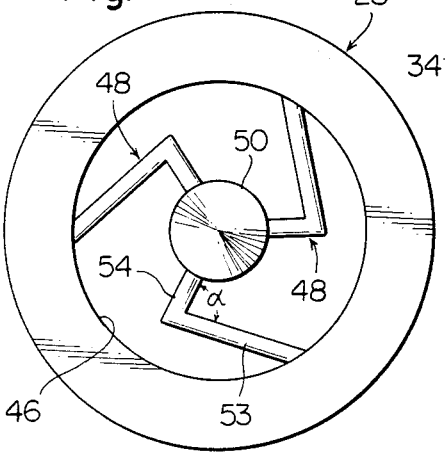
FIG. 4 is a top plan view of a second valve member in the closure of FIG. 1.
Figure 5:
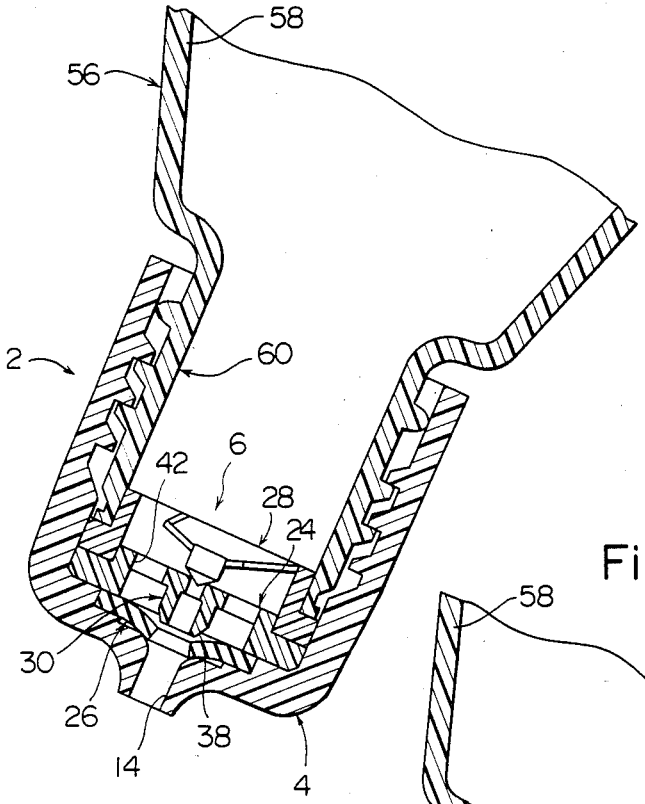
FIGS. 5 and 6 are sectional views, similar to FIG. 2, for illustrating the function of the closure of FIG. 1.

The automatic opening-closing mechanism 6 is comprised of a plug member 24, and a first valve member 26 and a second valve member 28 disposed over and beneath the plug member 24, respectively. With reference to FIG. 3 taken in conjunction with FIGS. 1 and 2, the plug member 24 may be formed of a suitable synthetic resin such as polypropylene or polyethylene, and is generally disc-like. An upwardly extending central projecting portion 30 is formed in the central part of the plug member 24. The outer circumferential portion 32 of the plug member 24 is formed in a relatively large thickness, and an annular flange 34 projecting radially outwardly is formed in the upper half of the plug member 24. An air introduction hole 36 is formed in, and extends through, the central projecting portion 30. The air introduction hole 36 may be of a circular cross-sectional shape. As is clearly depicted in FIG. 2, the central projecting portion 30 projects slightly upwardly of the upper surface of the thick outer circumferential edge portion 32, and the outer circumferential surface 38 of the upper end part of the central projecting portion 30 is formed in a tapered truncated conical shape. A relatively thin intermediate portion 40 exists between the central projecting portion 30 and the thick outer circumferential edge portion 32, and a plurality of (6 in the drawing) liquid discharge ports 42 are formed in the intermediate portion 40 at equiangular intervals. The liquid discharge ports 42 disposed around the air introduction hole 36 may also have a circular cross-sectional shape. It is critical that the first valve member 26 in the automatic opening-closing mechanism 6 should be formed of a flexible material. A material which is preferably used to form the first valve member 26 may be, for example, a synthetic rubber having a Shore A scale hardness, stipulated in JIS K-6301, of 5 to 80, especially 20 to 65. As is clearly shown in FIG. 1, the first valve member 26 may be of a flat annular plate shape, and a circular opening 44 is formed at its central part. The diameter of the circular opening 44 is set at a value greater than the maximum outside diameter of the upper end of the truncated conical circumferential surface 38 of the central projecting portion 30 in the plug member 24 but smaller than the maximum outside diameter of its lower end. if desired, the first valve member 26 may be formed in a ring-shape like the shape of an automobile tire. With reference to FIG. 4 taken in conjunction with FIGS. 1 and 2, the second valve member 28 may be formed of a suitable synthetic resin such as polypropylene or polyethylene, and has an annular base portion 46 and a central valve portion 50 connected to the base portion 46 via a lining portion 48. A radially outwardly projecting annular flange 52 is formed in the upper part of the base portion 46. The central valve portion 50 has a lower part having the shape of a solid cylinder and an upper part having the shape of a tapered cone. In the illustrated embodiment, the central valve portion 50 is connected to the base portion 46 via three linking portions 48 disposed at equiangular intervals. Each of the linking portions 48 is in the form of a slender filament, and its cross-sectional area is as small as about 0.2 to 0.7 $mm^2$. The linking portion 48 has a first part 53 extending from the inner circumferential surface of the base portion 46 inwardly in an upwardly inclined fashion and a second part 54 extending inwardly in an upwardly inclined fashion to the outer circumferential surface of the lower part of the central valve portion 50 while deflecting at a deflection angle $\alpha$, of preferably about 70 to 90 degrees to the first part 53.

With reference to FIG. 2, the closure 2 described above may be applied to a container 56 that can be molded from a suitable synthetic resin such as polyethylene. The container 56 is known per se, and may hold a liquid such as a shampoo or a washing liquor. It comprises a body portion 58 (only the upper end portion of which is shown in FIG. 2) which can be pressed elastically out of shape and a mouth-neck portion 60 having a nearly cylindrical shape. An external thread 62 is formed on the outer circumferential surface of the mouth-neck portion 60.

The method of applying the closure 2 to the mouth-neck portion 60 of the container 56 will be described. The second valve member 28 of the automatic opening-closing mechanism 6 is fitted in the mouth-neck portion 60 of the container 46 by partly inserting its base portion 46 into the inside of the mouth-neck portion 60, and causing the annular flange 52 to abut with the upper end surface of the mouth-neck portion 60. The plug member 24 in the automatic opening-closing mechanism 6 is superimposed on the second valve member 28. Specifically, the plug member 24 is laid on the second valve member 28 by partly inserting its circumferential edge portion 32 into the base portion 46 of the second valve member 28 and causing its annular flange 34 to abut with the annular flange 52 of the second valve member 28. As a result, the central valve portion 50 of the second valve member partly advances from below into the air introduction hole 36 of the plug member 24, and the conical upper part of the central valve portion 50 is kept elastically in close contact with the plug member 24 to thereby close the air introduction hole 36 of the plug member 24. The first valve member 26 of the automatic opening-closing mechanism 6 is superimposed on the plug member 24 by causing its outer circumferential edge portion to abut with the upper surface of the thick outer circumferential edge portion 32. As a result, the central projecting portion 30 of the plug member 24 projects slightly into the opening 44 formed in the first valve member 26, and the inner circumferential edge of the first valve member 26 is kept in close contact with the truncated conical outer circumferential surface 38 of the central projecting portion 30. Thus, the liquid discharge ports 42 of the plug member 24 are closed.

The outside closure member 4 is fitted over the mouth-neck portion 60 to which the automatic opening-closing mechanism 6 has been applied, and the internal thread 20 formed in the inner circumferential surface of the skirt wall 10 comes into engagement with the external thread 62 formed on the outer circumferential surface of the mouth-neck portion 60. When the outside closure member 4 has thus been mounted on the mouth-neck portion 60, the outside closure member 4 covers the automatic opening-closing mechanism 6 and the annular surface between the first annular step 16 and the second annular step 18 in the inside surface of the top wall 8 abuts with the outer circumferential edge portion of the first valve member 26. Hence, the outer circumferential edge portion of the first valve member 26 is held between the thick outer circumferential edge portion 32 of the plug member 24 and the top wall 8 of the outside closure member 4.

Figure 6:
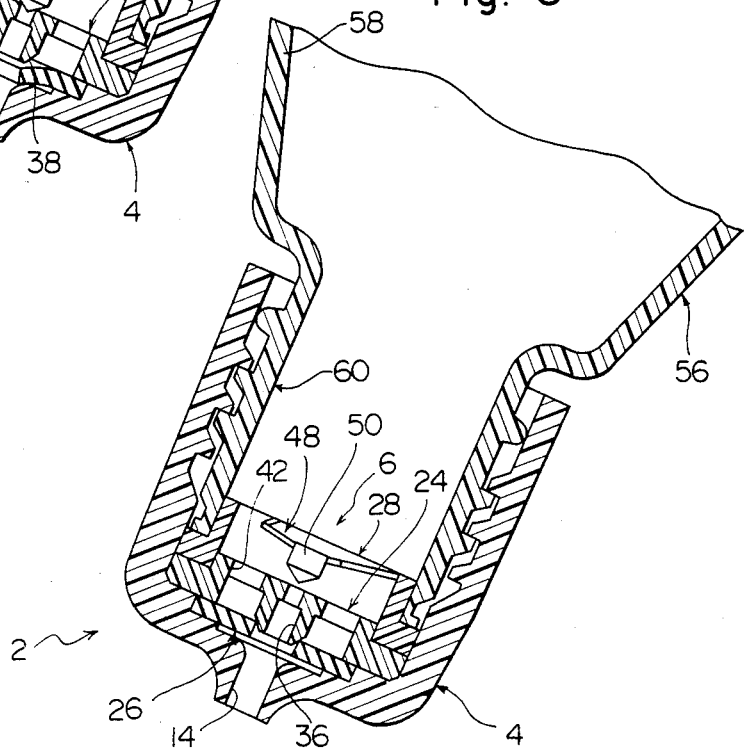

When the closure 2 has been mounted on the mouth-neck portion 50 of the closure 56 as above, the mouth-neck portion 60 is accurately closed by the closure 2 because the liquid discharge ports 42 of the plug member 24 are closed by the first valve member 26 and the air introduction hole 36 of the plug member 24 is closed by the second valve member 28. Even when the container 56 accidently falls down, the liquid held in it does not leak out. When it is desired to discharge the liquid from the container 56, its body portion 58 is held by hand and the container 56 is turned upside down. Then, the body portion 58 is pressed out of shape. As a result, the pressure inside the container 56 is increased, and the inner circumferential edge portion of the first valve member 26 is elastically bent and moved away from the outer circumferential surface 38 of the central projecting portion of the plug member 24. Hence, the plurality of the liquid discharge ports 42 in the plug member 24 are opened. The liquid moves through the discharge ports 42 and is discharged through the pour opening 14 formed in the outside closure member 4. When the pressing of the body portion 56 is stopped to allow it to return elastically to its original shape, the inner circumferential edge portion of the first valve member 26 elastically returns to its original state to close the discharge ports 42, and a negative pressure is created within the container 56. Consequently, as shown in FIG. 6, the linking portion 48 of the second valve member 28 are elastically bent to move the central valve portion 50 away from the plug member 24, and the air introduction hole 36 formed in the plug member 24 is opened. The atmospheric air comes into the container 56 through the pour opening 14 of the outside closure member 4 and the air-introduction hole 36 of the plug member 24. When the negative pressure in the container 56 is released by the introduction of the atmospheric air, the linking portions 48 of the second valve member 28 elastically return to their original state to allow the central valve portion 50 to close the air introduction hole 36. As a result, the mouth-neck portion 60 is closed.

While the present invention has been described in detail hereinabove with reference to the accompanying drawings showing one embodiment of the closure constructed in accordance with this invention, it should be understood that various changes and modifications are possible without departing from the scope of the invention described and claimed herein.

What we claim is:

1. A closure adapted to be applied to the mouth-neck portion of a container for holding a liquid at least a body portion of which can be elastically pressed out of shape, said closure comprising an automatic opening-closing mechanism to be mounted on the mouth-neck portion of the container and an outside closure member covering the automatic opening-closing mechanism and having a pour opening, said automatic opening-closing mechanism comprising a plug member having a centrally formed air introduction hole and a plurality of liquid discharge ports formed around the air introduction hole, a first valve member for opening and closing the liquid discharge ports and a second valve member for opening and closing the air introduction hole, said first valve member being formed of a flexible material and annular in shape and disposed over the plug member, and said first valve member being adapted to normally close the liquid discharge ports but when the pressure in the container is increased as a result of its body portion being pressed out of shape, to be elastically bent at its inside circumferential edge portion and to open the liquid discharge ports, and said second valve member having a base portion and a central valve portion connected to the base portion via an elastically bendable linking portion and disposed beneath the plug member, and said second valve member being adapted to normally close the air introduction hole by its central valve portion, but when the body portion of the container elastically returns to its original shape from its pressed state and a negative pressure is created in the container, to be elastically bent at its linking portion thereby displacing the central valve portion and thus to open the air introduction hole.

2. The closure of claim 1 wherein said outside closure member has a top wall and a cylindrical skirt wall extending downwardly from the peripheral edge of the top wall, and said pour opening is formed centrally in the top wall.

3. The closure of claim 1 wherein said plug member has a central projecting portion to be inserted into an opening formed centrally of the first valve member, said air introduction hole extends through the central projecting portion, and said liquid discharge ports are arranged around the projecting portion.

4. The closure of claim 3 wherein the outer circumferential surface of the upper end part of the central projecting portion in the plug member is of a tapered truncated conical shape, and the inner circumferential edge of the first valve member is usually kept in close contact with the outer circumferential surface of the upper end part of the central projecting portion.

5. The closure of claim 1 wherein the first valve member is of a flat annular plate shape.

6. The closure of claim 1 wherein the first valve member is formed of a synthetic rubber having a Shore A scale hardness of 5 to 80.

7. The closure of claim 6 wherein the first valve member is formed of a synthetic rubber having a Shore A scale hardness of 20 to 65.

8. The closure of claim 1 wherein the outer circumferential edge portion of the first valve member is held between the outside closure member and the plug member.

9. The closure of claim 1 wherein the base portion of the second valve member is annular, and a plurality of linking portions are disposed at equiangular intervals.

10. The closure of claim 9 wherein each of the linking portions is in the form of a slender filament.

11. The closure of claim 10 wherein each of the linking portions has one deflecting portion with a deflection angle of 70 to 90 degrees.

* * * * *